US007137777B2

(12) United States Patent
Fried et al.

(10) Patent No.: US 7,137,777 B2
(45) Date of Patent: Nov. 21, 2006

(54) DEVICE FOR SEPARATING FOREIGN PARTICLES OUT OF THE COOLING AIR THAT CAN BE FED TO THE ROTOR BLADES OF A TURBINE

(75) Inventors: Reinhard Fried, Nussbaumen (CH); Bernhard Weigand, Filderstadt-Sielmingen (DE)

(73) Assignee: Alstom Technology Ltd, Baden (CH)

( * ) Notice: Subject to any disclaimer, the term of this patent is extended or adjusted under 35 U.S.C. 154(b) by 40 days.

(21) Appl. No.: 10/882,335

(22) Filed: Jul. 2, 2004

(65) Prior Publication Data

US 2005/0002778 A1 Jan. 6, 2005

(30) Foreign Application Priority Data

Jul. 5, 2003 (DE) ..... 103 30 471

(51) Int. Cl.
*F01D 5/12* (2006.01)

(52) U.S. Cl. ..... 415/115; 415/121.2

(58) Field of Classification Search ..... 415/115, 415/121.2; 416/95, 96 R
See application file for complete search history.

(56) References Cited

U.S. PATENT DOCUMENTS 3,356,340 A * 12/1967 Bobo ..... 415/115
6,196,791 B1 * 3/2001 Tomita et al. ..... 415/115
6,413,044 B1 * 7/2002 Roeloffs et al. ..... 415/169.1

FOREIGN PATENT DOCUMENTS

EP 0 690 202 B1 1/1996
EP 1 174 589 A1 1/2002

* cited by examiner

*Primary Examiner*—Ninh H. Nguyen
(74) *Attorney, Agent, or Firm*—Steptoe & Johnson LLP

(57) ABSTRACT

A device separates foreign particles from cooling air fed to turbine rotor blades. The cooling air is fed directly or indirectly via stationary nozzle units to an annular space between wall parts of a turbine stator and rotating wheel disk as a cooling-air stream in the circumferential direction. The annular space communicates with ducts, arranged in the disk, for feeding the cooling air into the blades. A diverter unit is provided inside the annular space or so as to delimit the annular space on one side, so cooling air emerging from the nozzle units, before entering the ducts, is diverted on one side and foreign particles are centrifugally thrown into a radially outer part of the annular space and separated therefrom with a barrier-air fraction. The diverter unit has a surface region on which the stream impinges so it can be diverted radially outward through an angle greater than 90°.

36 Claims, 6 Drawing Sheets

DEVICE FOR SEPARATING FOREIGN PARTICLES OUT OF THE COOLING AIR THAT CAN BE FED TO THE ROTOR BLADES OF A TURBINE

CROSS-REFERENCE TO RELATED APPLICATIONS

This application claims priority to German application No. 103 30 471.1 filed on Jul. 5, 2003, the entire content of which is expressly incorporated herein by reference thereto.

FIELD OF THE INVENTION

The invention relates to a device for separating foreign particles out of the cooling air that can be fed to the rotor blades of a turbine, in particular for a gas turbine arrangement. The cooling air can be fed directly or indirectly via stationary nozzle units to an annular space that is formed between wall parts of a turbine stator and a rotating wheel disk, as a cooling-air stream is directed in the circumferential direction. The annular space is in communication with ducts, arranged in the wheel disk, for feeding the cooling air into the rotor blades. A diverter unit is provided inside the annular space or so as to delimit the annular space on one side. By means of the diverter device, the cooling air that emerges from the nozzle units, before entering the ducts, can be diverted on one side in such a way that foreign particles are centrifugally thrown into a radially outer part of the annular space and are separated out of the annular space together with a barrier-air fraction of the cooling air supplied.

BACKGROUND OF THE INVENTION

A device for separating foreign particles out of a cooling-air stream which for cooling purposes is fed to a turbine rotor blade, preferably of a gas turbine installation, of the generic type is known from EP 0 690 202 B1. In the known case, cooling air is fed via stationary swirl nozzles to an annular space, which is delimited between wall parts of the turbine stator and a rotor disk, to form a turbulent flow that propagates in the circumferential direction within the annular space. The swirl nozzles each have a tangential orientation in the circumferential direction of their arrangement within the turbine stator, with the individual nozzle axes in the respective tangential plane being set obliquely with respect to the axis of rotation of the rotor arrangement, in order to form a swirling flow within the annular space.

A metal diverter plate, which is L-shaped in cross-section, is provided inside the annular space, immediately downstream of the swirl nozzles, as seen in the direction of flow; the cooling air, on emerging from the swirl nozzles, impinges perpendicularly on the longer longitudinal limb of this diverter plate, which is preferably oriented radially with respect to the rotor arrangement, and is diverted radially outward. For design reasons, the diverter plate provides, on the radially inner side with respect to the outlet opening of the swirl nozzles, a flow dead space in which foreign particles inevitably accumulate, preferably through accumulation of relatively heavy and/or large foreign particles. Deposits of this nature on the surface of the radially inner, shorter L limb lead to a risk of contamination to the cooling-air stream that forms in the annular space which should not be underestimated yet to which it is quite obvious that no further attention is paid in the above-mentioned document.

Moreover, the same document reveals a further exemplary embodiment, in which an L-shaped part, which is formed with an acute angle in cross-section, is used as the metal diverter plate, with the cooling-air stream that emerges from the swirl nozzles impinging at an angle on the longer L-limb of the diverter plate; this angle causes the cooling-air stream to be at least partially deflected radially inward. In this case, it can be assumed that the deposition of foreign particles described above will occur to an even greater extent than in the first case described.

A further device for removing dust particles from the cooling air of a gas turbine is disclosed by EP 1 174 589 A1. In the case outlined above, as it were, wall parts of the guide vane and rotor blade, positioned axially opposite one another, of a rotor arrangement delimit a type of annular space into which a cooling-air stream is introduced as swirling stream. The foreign particle separation is performed in such a manner that the cooling air that emerges from a first nozzle arrangement impinges on a type of diverter unit, by means of which the cooling-air stream is divided into a partial air stream that is directed radially outward and a partial air stream that is directed radially inward. By providing certain flow links, the radially outwardly directed partial air stream, which has increased levels of foreign particles, is passed radially outward into the hot-gas stream of the gas turbine. The accumulation of foreign particles in the radially outwardly directed partial air stream originates from the centrifugal force that acts on the foreign particles and forms as a result of the swirling flow propagating in the circumferential direction after it has passed through the swirl nozzle openings. Although it is possible to separate out relatively high-mass foreign particles using the separation method described in this document, it is impossible to rule out lightweight and smaller dust or foreign particles being entrained by the radially inwardly directed cooling-air stream for further cooling of the turbine rotor blade.

SUMMARY OF THE INVENTION

The invention relates to designing a device for separating foreign particles out of the cooling air that can be fed to the rotor blades of a turbine in such a manner that, with the most simple and inexpensive technical measures possible, it is possible to remove, preferably completely but at least substantially, foreign particles from the cooling air flowing into the turbine rotor blades.

According to the invention, a device is provided for separating foreign particles out of the cooling air that can be fed to the rotor blades of a turbine, in particular for a gas turbine arrangement. Cooling air can be fed directly or indirectly via stationary nozzle units to an annular space that is formed between wall parts of a turbine stator and a rotating wheel disk. A cooling-air stream is directed in the circumferential direction, and the annular space is in communication with ducts, arranged in the wheel disk, for feeding the cooling air into the rotor blades. A diverter unit is provided inside the annular space or so as to delimit the annular space on one side, by means of which diverter device the cooling air that emerges from the nozzle units, before entering the ducts, can be diverted on one side in such a way that foreign particles are centrifugally thrown into a radially outer part of the annular space together with a barrier-air fraction of the cooling air supplied. The diverter unit has a surface region on which the cooling-air stream passing through the nozzle unit impinges, by means of which the cooling-air stream can be diverted radially outward through an angle α of greater than 90°.

This device according to the invention ensures that, together with the entirety of the cooling air, any foreign particles that are contained in the cooling-air stream are diverted radially outward, so that it is impossible for any deposits to form in a radially inner region.

To realize the inventive concept of optimized separation of foreign particles out of the cooling-air stream, a first solution variant provides a diverter unit that is connected to the turbine stator unit and in which the cooling-air stream emerging from the nozzle units, which are designed as swirl nozzles, has a direction of flow that intersects the radial direction of the rotor arrangement at right angles, even though the duct longitudinal axes of the individual nozzle units are inclined with respect to the rotor axis in order to impart a swirling flow that rotates in the circumferential direction within the annular space. In contrast to the diverter unit illustrated in EP 0 690 202 B1 cited in the introduction, the diverter unit that is designed in accordance with the invention has a surface region that faces the cooling-air stream emerging from the nozzle units and the inclination of which relative to the radial direction of the rotor arrangement is selected in such a manner that the entire cooling-air stream is diverted in the radially outward direction.

One preferred embodiment of the converter unit provides a concavely formed surface contour facing the nozzle units, the curvature of which surface, at least in the region of the surface region on which the cooling-air stream impinges directly, can be described by tangential planes that include an angle α of >90° with the axially oriented flow component of the cooling-air stream emerging from the nozzle units. For further radially outwardly directed cooling-air stream guidance, the diverter unit has a contour that ends freely in the annular space and serves as a flow detachment contour for the cooling-air stream that has been diverted radially outward, so that the cooling air that is mixed with foreign particles passes directly, without further flow obstacles, to the radially outer labyrinth seal, through which the cooling air mixed with foreign particles enters the hot-gas stream or working stream of the gas turbine installation.

Cooling air from which foreign particles have been virtually entirely removed is separated in a manner known per se by providing a through-opening between the contour of the diverter unit that ends freely as a detachment contour and a web of the wheel disk, as also is revealed in detail from the exemplary embodiments described below.

The diverter unit which is designed in accordance with the invention is therefore distinguished by the specific formation of the surface region facing the nozzle units, which in the simplest case is distinguished by a surface section that is inclined in a straight line, as described above. However, continuously curved concave surface curvatures have proven suitable for optimized flow guidance, making it possible to reduce flow losses caused by locally occurring build-up effects within the flow guidance.

A further exemplary embodiment provides for the duct longitudinal axis of the nozzle unit to be radially inclined, so that the cooling-air stream that is already emerging from the nozzle units has a radially outwardly oriented flow component. In this case too, the surface region of the diverter unit on which the cooling-air stream impinges is to be oriented parallel or at an inclination to the radial direction, in such a manner that the duct longitudinal axis includes a radially outwardly open angle α>90° with the surface region.

The two solution variants outlined above provide a diverter unit that is fixedly connected to the turbine stator unit; however, it also is appropriate for the diverter unit to be fixedly connected to the rotating wheel disk, so that the diverter unit rotates relative to the nozzle units arranged in a stationary position in the turbine stator. If the diverter unit is to be arranged on the rotating wheel disk, it is advantageous to use the radially outer web of the wheel disk, which together with a corresponding mating contour of the turbine stator forms the radially outer labyrinth seal. The diverter unit itself is in this case designed as an annular element and provides, in its radially outer region, a multiplicity of through-openings distributed uniformly over the circumferential direction, serving to branch off cooling air from which foreign particles have been removed, in order for it to be passed on into the cooling ducts of the wheel disk and the turbine rotor blade connected thereto.

Like the diverter unit that is connected to the turbine stator in a stationary position, the diverter unit connected to the rotating wheel disk also provides a surface region that is directly exposed to the cooling-air stream from the nozzle units and through which the cooling-air stream that emerges from the nozzle units can be diverted radially outward through an angle α>90°.

Depending on the arrangement of duct longitudinal axes of the individual nozzle units, which, as in the case outlined above, may be arranged perpendicular or inclined with respect to the radial direction, it also is possible to generate a swirling flow that propagates in the circumferential direction within the annular space, even though the individual duct longitudinal axes of the nozzle units run coparallel to the rotor axis or the projection thereof runs coparallel to the rotor axis. This is made possible by radially oriented fins that are arranged on the diverter unit and are arranged facing the nozzle units, preferably equidistantly with respect to one another along the diverter unit. The rotation of the diverter unit and the fins connected to it causes at least some of the cooling air flowing into the annular space through the nozzle units to be entrained in the direction of rotation by the fin flanks projecting into the annular space, thereby inducing a cooling-air stream oriented in the circumferential direction within the annular space.

Further details in this respect are to be found in the corresponding exemplary embodiments with reference to the drawings.

A second proposed solution for improving the separation of foreign particles out of the cooling air that can be fed to the rotor blades of a turbine provides a concrete improvement to the device described in EP 1 174 589 A1 for removing foreign particles or dust particles from the cooling air of a gas turbine. Unlike in the case outlined above, the diverter unit, together with wall parts of the turbine stator unit, encloses a type of annular chamber in the sense of a separating chamber, in which the dust or foreign particles are separated out of the cooling air that is fed to the turbine rotor blade for cooling purposes. In this case, the cooling air originating from a compressor unit flows via a nozzle unit into the annular chamber; according to the invention, the nozzle units each provide a nozzle duct having a duct longitudinal axis that determines the direction of flow of the cooling-air stream and is inclined radially in such a manner that the cooling-air stream passing through the nozzle duct is directed radially outward. The annular chamber is connected, via at least two through-openings, to the annular space, which is delimited by wall parts of the turbine stator and the rotating wheel disk. One of the at least two through-openings is located on the radially outer side, between the diverter unit and the turbine stator unit, and the other is arranged on the radially inner side, with the duct longitudinal axis of the nozzle unit being arranged aligned with the radially outer through-opening. The cooling air mixed with foreign particles therefore flows through the annular chamber through the radially outer through-opening, virtually without obstacle, and then passes over corresponding flow contours provided at the rotating wheel disk and the turbine stator unit without obstacle into the working duct of the gas turbine. Therefore, on account of the radially outwardly directed cooling-air stream, there is fundamentally no need for centrifugal forces acting on the individual foreign particles, as is the case in the prior art cited above, to produce a desired separation effect. Although in the case according to the invention the cooling air flowing into the annular chamber in the circumferential direction also causes centrifugal forces to act on the foreign particles, thereby advantageously boosting the separation effect, the separation effect is not based exclusively on the centrifugal effect, thereby ensuring that even foreign particles of relatively low mass can be extracted from the cooling air that is actually to be fed to the rotating wheel disk.

Further details that provide a more detailed description of the embodiment of the invention in accordance with two alternative solutions are given below in the respective exemplary embodiments.

BRIEF DESCRIPTION OF THE DRAWINGS

The invention is described below by way of example, and without restricting the general concept of the invention, on the basis of exemplary embodiments and with reference to the drawings, in which.

DETAILED DESCRIPTION OF THE PREFERRED EMBODIMENTS

Figure 1:
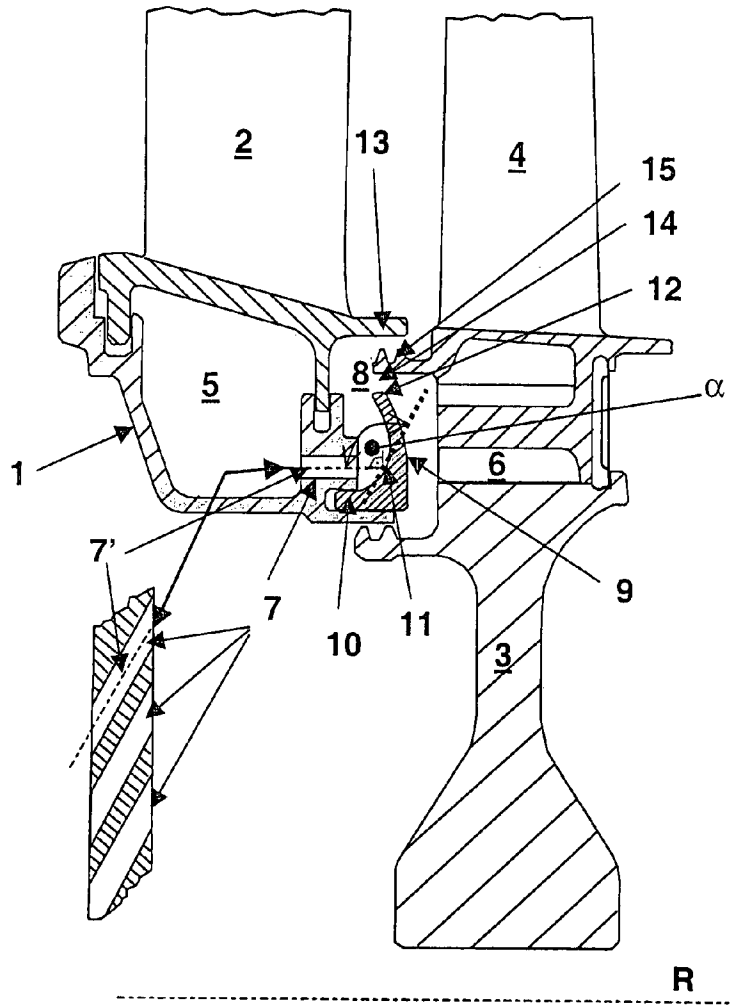
FIGS. 1 and 2 show longitudinal sections through a turbine stator unit and rotating wheel disk with a diverter unit secured in a stationary position to the turbine stator unit.

FIG. 1 shows a longitudinal section through a turbine stator 1 having a guide vane 2 that is fixedly connected thereto and a wheel disk 3, which is arranged such that it can rotate about the rotor axis R and has a turbine rotor blade 4 secured to it. Cooling air which is mixed with foreign particles, for example dust particles, passes from a compression unit (not shown) into a volume 5 enclosed between guide vane 2 and turbine stator 1. Specifically, the cooling air supplied by the compression unit is to be separated from the foreign particles, and the cleaned cooling air is to be passed, for further cooling of the rotor blade 4, into the cooling ducts 6 provided accordingly for this purpose within the wheel disk 3, which are connected to a hollow-chamber system provided accordingly for cooling purposes within the rotor blade 4.

To separate the foreign particles out of the cooling air fed by the compression unit, the cooling air passes out of the volume 5, via nozzle units 7 designed as swirl nozzles, into an annular space 8 which is delimited by wall parts of the turbine stator 1 and the rotating wheel disk 3 and which, moreover, is delimited on the radially outer side by projecting webs of the guide vane 2 and rotor blade 4 in the style of a labyrinth seal 13 and on the radially inner side by corresponding webs of the turbine stator 1 and of the wheel disk 3, likewise in the form of a labyrinth seal.

In the middle of the annular space 8 there is a diverter unit 9, which is fixedly connected to the turbine stator 1. The diverter unit 9 is designed as an annular component and substantially has a cross-section in the form of an angle profile, which provides a lower connecting web 10 that h projects into a securing groove with corresponding mating contours within the turbine stator 1.

The diverter unit 9 provides a surface region 11 on which the cooling-air stream passing through the nozzle unit 7 impinges, with the surface region 11 being inclined with respect to the direction of flow of the cooling-air stream in such a manner that the cooling-air stream is diverted outward through an angle $\alpha>90°$. In this way, the cooling-air stream passing through the nozzle units 7, together with all the foreign particles that it contains, experiences a radially outwardly directed deflection. In this way, any deposits of foreign particles between the nozzle unit 7 and the surface of the radially inner connecting web 10 of the diverter unit 9 are avoided.

In the exemplary embodiment shown, the nozzle units 7 have duct longitudinal axes 7' which, although oriented perpendicular to the radial direction, according to the detailed illustration (cf. double arrow illustration), have a tangential component for inducing a swirling flow that propagates in the circumferential direction inside the annular space 8.

In the exemplary embodiment shown, the surface contour of the diverter unit 9 facing the nozzle units 7 is designed as a concavely curved surface which, in the direction in which medium flows over it, has a freely ending contour 12 that is designed as a flow detachment edge for the radially outwardly directed flow stream. The flow stream that is mixed with foreign particles, also referred to as the barrier-air fraction, therefore passes via the radially outer labyrinth seal 13 into the working duct of the turbine arrangement. A through-opening 14 through which a cooling-air fraction from which foreign particles have been removed is branched off, is provided between the freely ending contour 12 of the diverter unit 9 and the radially outer web 15 of the wheel disk 3 or the rotor blade 4. To ensure that no foreign particles pass through the through-opening 14 out of the main direction of flow along the barrier-air fraction, the freely ending contour 12 projects beyond the web 15 along the direction of flow of the barrier-air fraction, so that it is impossible for any swirling which would divert the foreign particles out of the barrier-air fraction to form at this location.

Figure 2:
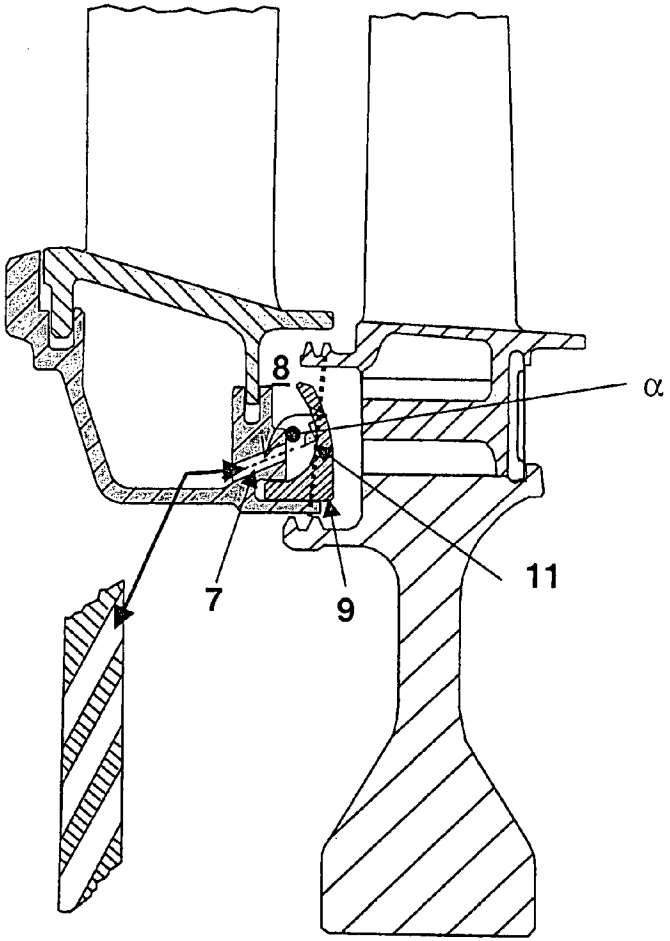

The exemplary embodiment illustrated in FIG. 2, with the exception of the three-dimensional position of the duct longitudinal axis of the nozzle unit 7, is the same as the exemplary embodiment illustrated in FIG. 1. In the case illustrated in FIG. 2, the duct longitudinal axes 7' of each individual nozzle unit 7 are additionally inclined radially outward, so that the cooling-air stream that emerges from the nozzle units 7 into the annular space 8 acquires a radially outwardly directed flow component even before it comes into contact with the respective surface region 11 of the diverter unit 9. In this case too, the surface region 11 on which the cooling stream impinges directly after it has passed through the nozzle unit 7 is inclined in such a manner that the cooling stream is deflected radially outward through an angle $\alpha>90°$. On account of the radially oriented inclination predetermined by the nozzle units, it is also possible, as a departure from the concavely curved surface, facing the nozzle unit 7, of the diverter unit 9 shown in FIG. 2, to provide an alternatively designed diverter unit that only has a surface region running parallel to the radial direction. This would enable the diverter unit to be designed as a right-angled L profile.

Figure 3:
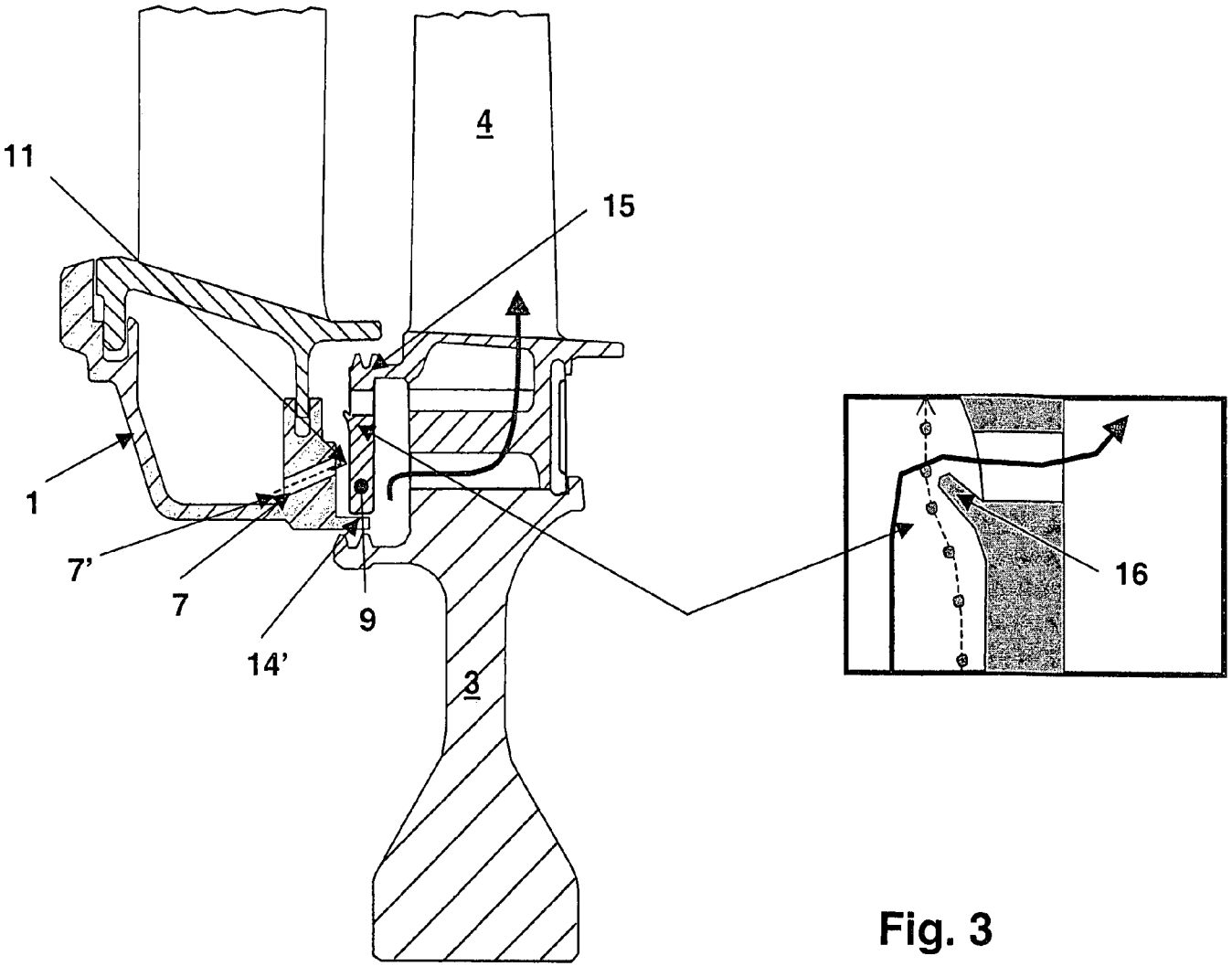
FIG. 3 shows a longitudinal section through a turbine stator unit and rotating wheel disk with a diverter unit that is fixedly connected to the rotating wheel disk.

The exemplary embodiment illustrated in FIG. 3, by contrast with the exemplary embodiments above, provides a diverter unit 9 that is fixedly connected to the rotating wheel disk 3. In detail, the arrangement of the nozzle units 7 within the turbine stator 1 corresponds to the exemplary embodiment shown in FIG. 2. On account of the cooling-duct longitudinal axis 7' directed obliquely radially outward, it is possible to configure the surface region 11 of the diverter unit 9 in rectilinear form and, at the same time, to ensure that the cooling-air stream that emerges from the nozzle units 7 is completely diverted radially outward.

Next to the web 15, the diverter unit 9, the radially outer region of which is fixedly connected to the web 15 of the wheel disk 3, has through-openings 14, through which cooling air is branched off for further cooling from the barrier-air fraction, that passes via the labyrinth seal 13 into the working duct of the turbine arrangement. To effectively prevent foreign particles from entering through the through-opening 14, there is a web 16, that diverts the flow away from the through-opening 14, provided at the diverter unit 9 in front of the through-opening 14, as seen in the direction of flow, which web, in accordance with the detailed illustration presented in FIG. 3, diverts the particle stream (dot-dashed line) away from the through-opening 14 whereas cooling air without any foreign particles (solid bold line in the detailed illustration) passes through the through-opening 14.

A clear intermediate gap 14', through which cooling air for further cooling of the rotor blade 4 also passes, is provided on the radially inner side between the turbine stator 1 and the diverter unit 9 by virtue of the diverter unit 9 being arranged with rotary motion with respect to the turbine stator 1.

Figure 4:
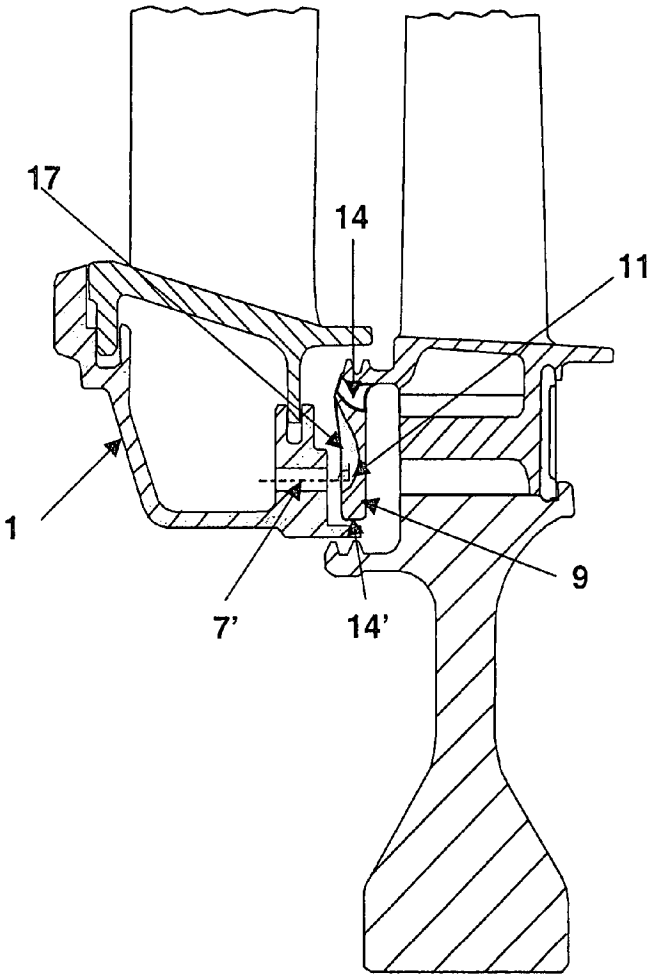
FIGS. 4 and 5 show alternative exemplary embodiments to the arrangement illustrated in FIG. 3.
Figure 5:
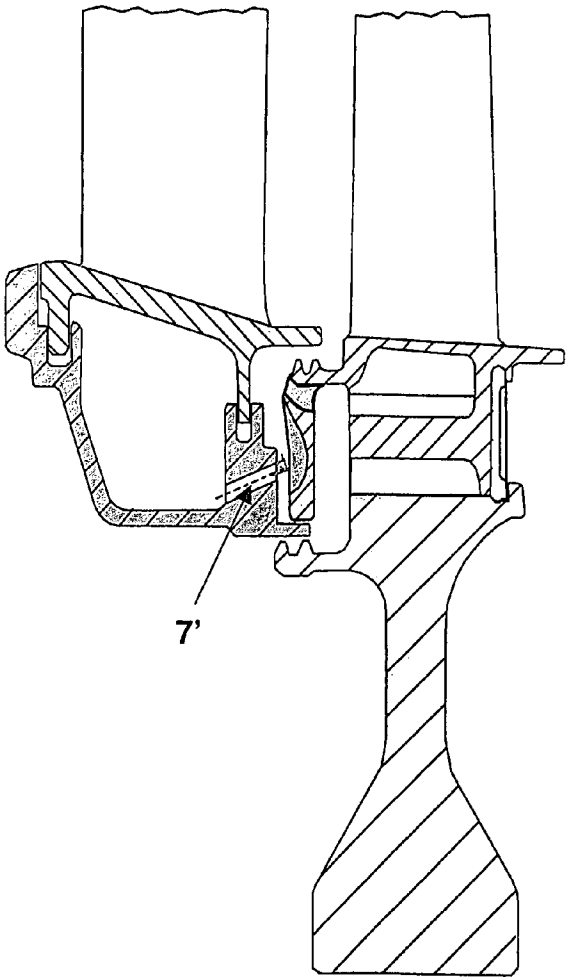

FIGS. 4 and 5 show an embodiment that represents an improvement on FIG. 3, having diverter units 9 that are likewise fixedly connected to the rotating wheel disk 3. FIG. 4 shows an arrangement with a cooling-duct longitudinal axis 7' that intersects the radial direction at right angles, whereas FIG. 5 illustrates an exemplary embodiment with a cooling-duct longitudinal axis 7' inclined radially outward. FIG. 4 and FIG. 5 are identical in further details, and consequently the explanation of the figures can be restricted to FIG. 4. The diverter unit 9 has a concavely shaped surface region 11 that deflects the cooling-air stream emerging from the nozzle unit 7 radially outward. The through-openings 14 and the radially inner intermediate gap 14' between the rotating diverter unit 9 and the stationary turbine stator 1 serve to pass on the cooling air from which foreign particles have been removed. Furthermore, the diverter unit 9 provides, to the sides of the nozzle unit 7, elements 17 that are of fin-like configuration, as can be seen in detail in particular with reference to FIG. 6*b*. The fin-like elements 17 each have a surface that is oriented perpendicular to the axis of rotation of the wheel disk 3 and by means of which the cooling air that enters the annular space 8 is set in rotation in the circumferential direction. Although, as mentioned in the introduction, there is already a circumferentially swirling flow inside the annular space 8, on account of the tangential tilting of the duct longitudinal axes 7' of the nozzle units 9 (cf. in this respect in particular the description given in connection with FIGS. 1 and 2), the annular flow that forms is additionally boosted further by the fin-like elements 17 inside the annular space.

Figure 6:
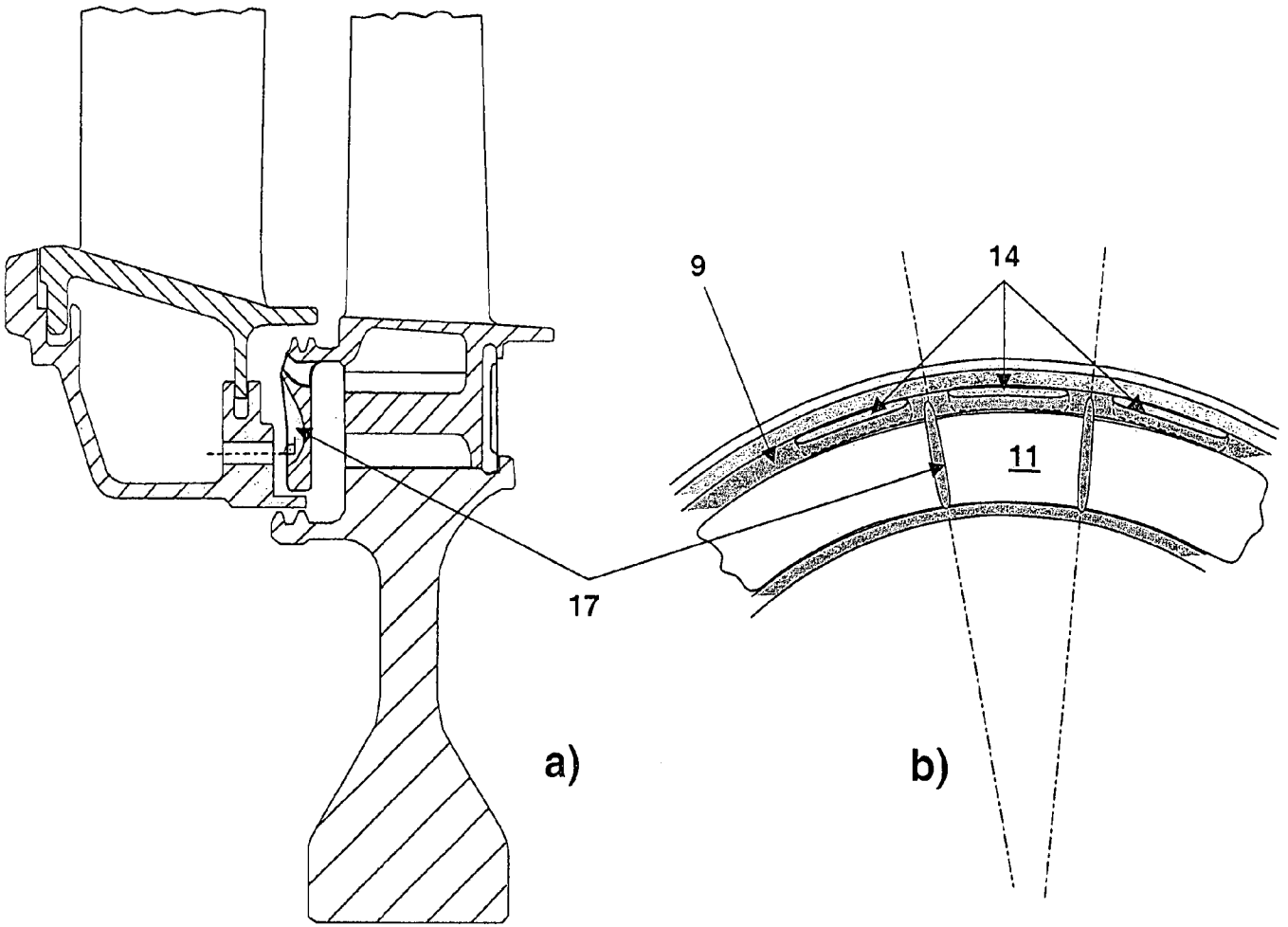
FIG. 6 illustrates the arrangement of fin-like elements along the diverter unit.

Alternatively, it is possible to dispense with the tangential tilting of the duct longitudinal axes 7' of the nozzle units 7 altogether, in which case the cooling-air stream that propagates in the circumferential direction, inside the annular space, is exclusively driven by the entraining effect of the fin-like elements 17. For a better illustration of the arrangement and effect of the fin-like elements 17, reference is made to FIG. 6, in which FIG. 6*a* corresponds to the exemplary embodiment shown in FIG. 4. The fin-like elements 17 are equidistantly spaced apart from one another along the surface region 11 of the diverter unit 9, as illustrated in FIG. 6*b*. It is preferable for two fin-like elements 17 arranged adjacent to one another to enclose a passage opening 14.

Figure 7:
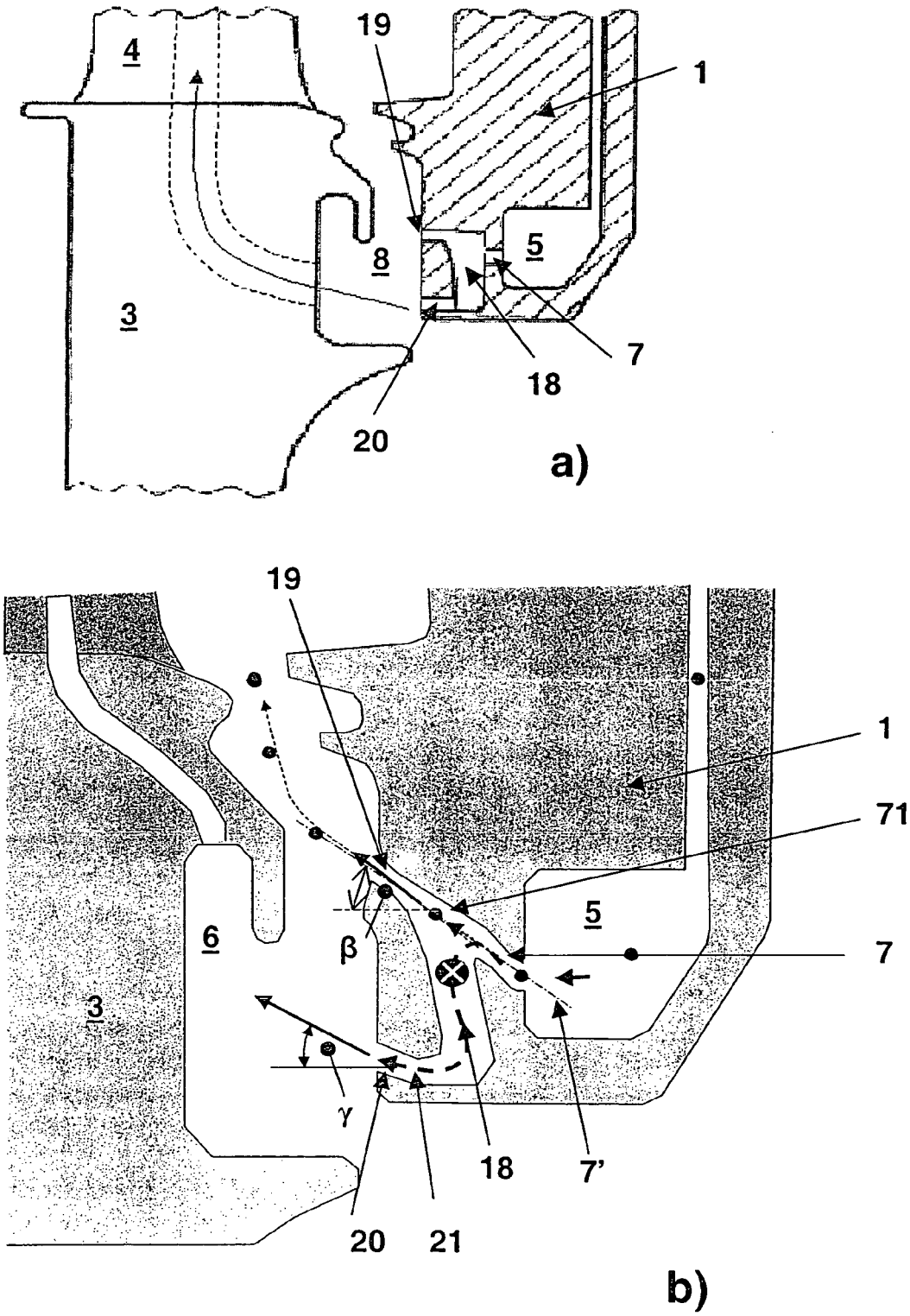
FIGS. 7*a, b* diagrammatically depict a foreign-body separation device designed in accordance with the invention (cf. FIG. b) compared to the prior art (cf. FIG. a)

FIG. 7 serves to describe a further alternative device according to the invention for separating foreign particles out of the cooling air that can be fed to the rotor blades of a turbine, preferably for a gas turbine installation.

FIG. 7*a* serves to describe a prior art which is known per se and provides a turbine stator 1 that is arranged axially with respect to a rotor arrangement (not shown in more detail) of a rotating wheel disk 3 with corresponding rotor blade 4. As in the case that has already been outlined above, a compression unit (not shown in more detail) is responsible for feeding cooling air into a volume 5, from which cooling air emerges into an annular chamber 18 via a nozzle unit 7. The nozzle unit 7 is designed in a corresponding way to the nozzle unit that already has been described with reference to the exemplary embodiment shown in FIG. 1, i.e. the cooling air that emerges into the annular chamber 18 through the nozzle unit 7 propagates therein as a circumferential swirling flow. On account of the centrifugal force caused by the circumferentially swirling flow, the foreign particles that are present in the swirling flow are forced radially outward and pass through the radially outer through-opening 19 into the annular space 8, which is delimited by wall parts of the rotating wheel disk 3 and of the turbine stator 4, and ultimately pass onward into the working duct of the gas turbine.

By contrast, on the radially inner side with respect to the annular chamber 18 there is a further through-opening 20, through which cooling air without any foreign particles, i.e. clean cooling air, passes and enters an axially opposite cooling duct 6 within the rotating wheel disk 3.

To effectively improve the separation effect of the deposition device of the prior art which is known per se, as illustrated in FIG. 7*a*, the nozzle unit 7 shown in FIG. 7*b* provides a nozzle duct 71 with a duct longitudinal axis 7' that determines the direction of flow of the cooling-air stream and is radially inclined in such a manner that the cooling-air stream passing through the nozzle duct 71 is directed radially outward. At the same time, the radially outer through-opening 19 is arranged aligned with the nozzle duct 71, so that foreign particles can propagate freely and without obstacle along the main direction of flow. The duct longitudinal axis 7' of the nozzle duct 71 includes an angle $\beta$ of preferably between 40° and 50° with the axis of rotation of the wheel disk 3.

The annular chamber 18 is delimited on one side by the turbine stator 1 and on the other side by the diverter unit 9, which encloses a substantially radially oriented flow duct within the annular chamber 18. Starting from the nozzle duct 71, it is not possible for the foreign particles, on account of the centrifugal force caused by the circumferentially swirling flow, to be deflected radially inward along the annular chamber 18 and to pass through the radially inner through-opening 20.

The outlet contour of the through-opening 20 also, in a comparable way to the through-opening 19, provides a flow duct 21, the flow-duct longitudinal axis of which is inclined radially outward through an angle γ, where preferably $0° < \gamma \leqq 35°$. This ensures that the clean cooling air opens out in the direction of the cooling duct 6 that is present in the rotating wheel disk 3.

Figure 8:
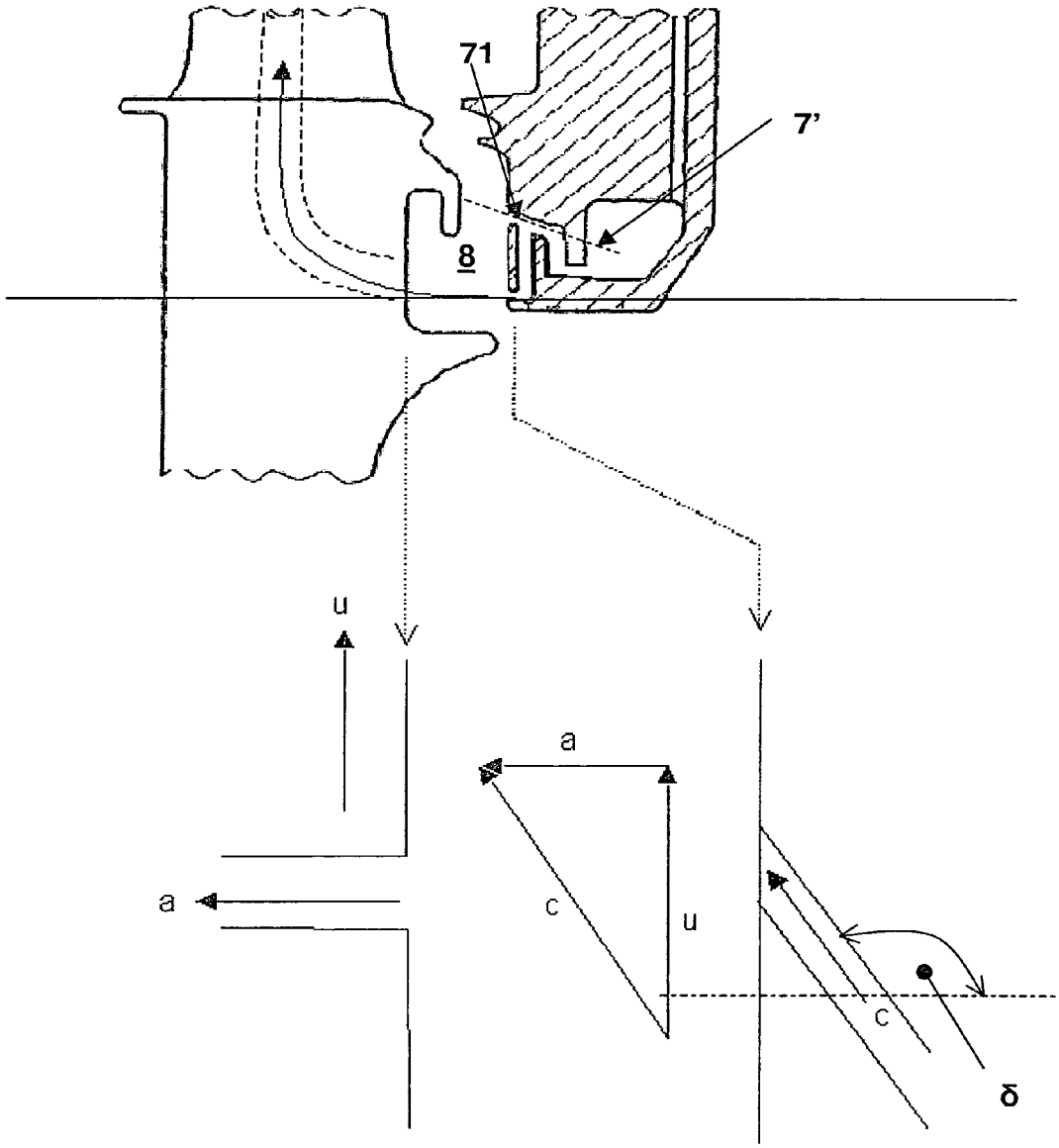
FIG. 8 uses flow velocity components to illustrate the separation effect of the embodiment according to the invention illustrated in FIG. 7*b*.

Finally, FIG. 8 reveals a further diagrammatic longitudinal-sectional illustration of the device that already has been illustrated in FIG. 7*b* for separating out foreign particles. The radially outwardly inclined duct longitudinal axis 7' of the nozzle duct 71, which is simultaneously also inclined obliquely with respect to the tangential plane in order to apply a swirling flow that propagates in the circumferential direction inside the annular space 8, is a crucial factor. The diagrammatically illustrated duct supply in the lower part of FIG. 8 shows an axial plan view of the nozzle duct 71 that is inclined through an angle δ with respect to the axis of rotation. This results in a swirling flow c composed of two flow direction components a and u within the annular space 8.

LIST OF DESIGNATIONS

1 Turbine stator
2 Guide vane
3 Wheel disk
4 Rotor blade
5 Volume
6 Cooling duct
7 Nozzle unit
7' Duct longitudinal axis
71 Nozzle duct
8 Annular space
9 Diverter unit
10 Connecting web
11 Surface region
12 Freely ending contour
13 Labyrinth seal
14 Through-opening
14' Intermediate gap
15 Web
16 Flow-repelling contour
17 Fin-like element
18 Annular chamber
19 Radially outer through-opening
20 Radially inner through-opening
21 Flow duct

What is claimed is:

1. A device for separating foreign particles out of cooling air to be fed to rotor blades of a turbine, the device comprising:

stationary nozzle units for feeding the cooling air to an annular space formed between wall parts of a turbine stator and a rotating wheel disk, the nozzle units configured for directing the cooling air in a stream flowing in a circumferential direction inside the annular space;

ducts communicating with the annular space for feeding the cooling air into the rotor blades, the ducts being arranged in the wheel disk;

a diverter unit associated with the annular space and comprising a surface region;

wherein the diverter unit is configured such that before the cooling air enters the ducts, foreign particles in the cooling air emerging from the nozzle units are centrifugally moved into a radially outer part of the annular space and are separated out of the annular space together with a barrier-air fraction of the cooling air; and wherein the surface region of the diverter unit is configured such that when the stream of cooling air passes through the nozzle units and impinges the surface region, the stream of cooling air is diverted by the surface region in a radially outward direction through an angle greater than 90°.

2. The device of claim 1, wherein the nozzle units feed the cooling air directly to the annular space.

3. The device of claim 1, wherein the nozzle units feed the cooling air indirectly to the annular space.

4. The device of claim 1, wherein the annular space is delimited on the radially outer part and an inner side by sections of axially protruding webs of the turbine stator and of the wheel disk, the webs having a circumferentially overlapping arrangement and forming locking seals with respect to spaces in the turbine in which the pressure is lower than in the annular space, and wherein the locking seals include a radially outer locking seal disposed such that the barrier-air fraction together with the foreign particles enters the turbine duct therethrough.

5. The device of claim 4, wherein the radially outer locking seal is formed as a labyrinth seal for spatially demarcating the annular space from a radially outer turbine duct.

6. The device of claim 4, wherein the diverter unit has a contour that ends freely in the annular space, serves as a flow detachment contour for the stream of cooling air diverted radially outward, and permits further flow to propagate without obstacle in a direction of the radially outer locking seal with respect to the barrier-air fraction mixed with foreign particles.

7. The device of claim 6, wherein the flow detachment contour is followed, as seen in the direction of flow of the barrier-air fraction, by an open flow region unobstructed by flow obstacles.

8. The device of claim 6, wherein a through-opening is provided adjacent to the freely ending contour on the radially outer part for permit cooling air to be fed into the ducts.

9. The device of claim 8, wherein the through-opening is delimited by the freely ending contour of the diverter unit and a web of the wheel disk, and the web is set back from the flow of cooling air over the freely ending contour.

10. The device of claim 1, wherein the diverter unit is fixedly connected to the turbine stator, and the surface region is spaced from the nozzle units.

11. The device of claim 1, wherein the nozzle units each comprise a nozzle duct with a duct longitudinal axis, the axis defining a direction of flow of the stream of cooling air and being oriented perpendicular to a radial direction of the wheel disk that rotates about another axis, and wherein the surface region is configured so that the duct longitudinal axis includes a radially outwardly open angle of greater than 90° with the surface region.

12. The device of claim 11, wherein each duct longitudinal axis is inclined radially and the surface region is oriented so that each duct longitudinal axis includes a radially outwardly open angle of greater than 90° with the surface region.

13. The device of claim 12, wherein the surface region is oriented parallel to the radial direction.

14. The device of claim 12, wherein the surface region is oriented at an inclination to the radial direction.

15. The device of claim 1, wherein the diverter unit is configured as an annular component and further comprises a cross-section with an angled profile, a connecting web for fixedly joining the diverter unit to the turbine stator, and a section that includes the surface region and projects beyond the nozzle unit at a distance therefrom with the freely ending contour oriented radially outward.

16. The device of claim 15, further comprising a transition contour provided between the connecting web and the section that includes the surface region.

17. The device of claim 1, wherein the diverter unit is fixedly connected to the rotating wheel disk, and the surface region is disposed in spaced, opposing relation to the nozzle unit.

18. The device of claim 17, wherein the diverter unit is connected to a radially outer web of the wheel disk, and at least one through-opening is provided in a radially outer region of the diverter unit for permitting cooling air to be fed into the ducts.

19. The device of claim 18, wherein a freely ending contour projects axially beyond the through-opening and is provided directly adjacent to the through-opening on a radially inner side, the contour serving as a flow detachment contour for the stream of cooling air diverted radially outward, and permits further flow to propagate without obstacle in a direction of the radially outer locking seal with respect to the barrier-air fraction mixed with foreign particles.

20. The device of claim 19, wherein the flow detachment contour is followed, as seen in the direction of flow of the barrier-air fraction, by an open flow region unobstructed by flow obstacles.

21. The device of claim 17, wherein the diverter unit further comprises a radially inner, free end region that together with a web of the turbine stator encloses an intermediate gap for cooling air to pass in order also to be fed into the ducts.

22. The device of claim 17, wherein the diverter unit further comprises at least one fin-like element radially facing the annular space and having a surface oriented perpendicular to the direction of rotation of the wheel disk.

23. The device of claim 22, wherein a plurality of fin-like elements divide the diverter unit into sectors.

24. The device of claim 1, wherein the turbine is part of a gas turbine arrangement.

25. A device for separating foreign particles out of cooling air to be fed to rotor blades of a turbine, the device comprising:

stationary nozzle units for feeding the cooling air to an annular space formed between wall parts of a turbine stator and a rotating wheel disk, the nozzle units configured for directing the cooling air in a stream flowing in a circumferential direction inside the annular space;

ducts communicating with the annular space for feeding the cooling air into the rotor blades, the ducts being arranged in the wheel disk;

a diverter unit associated with the annular space;

wherein the diverter unit is configured such that before the cooling air enters the ducts, foreign particles in the cooling air emerging from the nozzle units are centrifugally moved into a radially outer pan of the annular space and are separated out of the annular space together with a barrier-air fraction of the cooling air; and wherein the nozzle units each comprise a nozzle duct with a duct longitudinal axis that determines a direction of flow of the stream of cooling air and is inclined radially to direct the stream of cooling air moving past the nozzle duct radially outward.

26. The device of claim 25, wherein the diverter unit is fixedly connected to the turbine stator and together with the wall parts of the turbine stator delimits an annular chamber downstream from a direction of flow through the nozzle unit, wherein the diverter unit further comprises at least two through-openings leading to the annular space, with a first through-opening arranged on a radially outer side and a second through-opening arranged on a radially inner side, and wherein the first through-opening is arranged to be aligned with the duct longitudinal axis.

27. The device of claim 26, wherein the annular chamber comprises a substantially radially oriented flow duct, which in a radially outward direction opens out into the region of the stream of cooling air that passes through the nozzle duct and is directed radially outward, and which on the radially inner side is connected to the second through-opening.

28. The device of claim 26, wherein a flow duct is provided upstream of the second though-opening, as seen in the direction of flow and the flow duct has a flow-duct longitudinal axis that is inclined radially outward by an angle $\gamma$, wherein $0° < \gamma \leqq 35°$.

29. The device of claim 25, wherein proximate the first through-opening, the diverter unit comprises a contour that narrows in a through-flow direction, with a decrease in cross-section of flow.

30. The device of claim 25, wherein the duct longitudinal axis is radially inclined at an angle $\beta$ with respect to an axis of rotation of the wheel disk, wherein $10° \leqq \beta \leqq 60°$.

31. The device of claim 25, wherein the duct longitudinal axis is radially inclined at an angle $\beta$ with respect to an axis of rotation of the wheel disk, wherein $40° \leqq \beta \leqq 50°$.

32. The device of claim 25, wherein the duct longitudinal axis of each of the nozzle units includes an angle $\delta$ with an axis of rotation of the wheel disk within a tangential plane at the location of the nozzle unit, wherein $\delta > 0°$.

33. The device of claim 25, wherein the nozzle units feed the cooling air directly to the annular space.

34. The device of claim 25, wherein the nozzle units feed the cooling air indirectly to the annular space.

35. The device of claim 25, wherein the turbine is part of a gas turbine arrangement.

36. A device for separating foreign particles out of cooling air to be fed to rotor blades of a turbine, the device comprising:

stationary nozzle units for feeding the cooling air to an annular space formed between wall parts of a turbine stator and a rotating wheel disk, the nozzle units configured for directing the cooling air in a stream flowing in a circumferential direction inside the annular space;

ducts communicating with the annular space for feeding the cooling air into the rotor blades, the ducts being arranged in the wheel disk;

a diverter unit associated with the annular space and comprising an arcuate surface region configured to direct the cooling air when impinging thereon through a change in angular direction greater than 90°;

wherein the diverter unit is configured such that before the cooling air enters the ducts, foreign particles in the cooling air emerging from the nozzle units are centrifugally moved into a radially outer part of the annular space and are separated out of the annular space together with a barrier-air fraction of the cooling air.

* * * * *

UNITED STATES PATENT AND TRADEMARK OFFICE

CERTIFICATE OF CORRECTION

PATENT NO. : 7,137,777 B2
APPLICATION NO. : 10/882335
DATED : November 21, 2006
INVENTOR(S) : Fried et al.

It is certified that error appears in the above-identified patent and that said Letters Patent is hereby corrected as shown below:

In claim 25, Col. 12, line 4, replace “pan” with --part--.

Signed and Sealed this

Twenty-eighth Day of August, 2007

JON W. DUDAS
*Director of the United States Patent and Trademark Office*